US006163900A

United States Patent [19]

Stevenson

[11] Patent Number: 6,163,900

[45] Date of Patent: Dec. 26, 2000

[54] FOLDING RV FURNITURE

[76] Inventor: Edward Stevenson, 4991 Old Ranch Rd., La Verne, Calif. 91750

[21] Appl. No.: 09/316,336

[22] Filed: May 21, 1999

[51] Int. Cl.[7] ..... A47C 17/64

[52] U.S. Cl. ..... 5/118; 5/37.1; 5/43

[58] Field of Search ..... 5/37.1, 43, 45, 5/118, 58, 312, 136, 137, 138, 139, 140, 141, 142, 143, 144; 296/63, 65.01, 65.16, 156; 297/353, 43

[56] References Cited

U.S. PATENT DOCUMENTS

| | | | |
|---|---|---|---|
| 2,605,912 | 8/1952 | Small et al. . | |
| 2,674,300 | 4/1954 | Liljengren et al. | 5/137 |
| 2,953,792 | 9/1960 | Fleischer . | |
| 3,179,462 | 4/1965 | Hagen . | |
| 3,675,965 | 7/1972 | Burdett | 296/23 |
| 3,734,558 | 5/1973 | Stead | 296/23 |
| 3,800,337 | 4/1974 | Mizelle | 5/43 |
| 3,877,086 | 4/1975 | Bue et al. | 5/9 R |
| 3,961,716 | 6/1976 | Renaud | 214/85 |
| 3,984,140 | 10/1976 | Robertson | 296/23 |
| 4,005,898 | 2/1977 | Way | 296/23 |
| 4,110,855 | 9/1978 | Acker | 5/45 |
| 4,625,347 | 12/1986 | McElmurry et al. | 5/43 |
| 4,639,953 | 2/1987 | McElmurry et al. | 5/43 |
| 4,854,631 | 8/1989 | Laursen | 296/158 |
| 5,314,200 | 5/1994 | Phillips | 280/400 |
| 5,755,478 | 5/1998 | Kamiya et al. | 296/24.1 |
| 5,787,522 | 8/1998 | Swihart | 5/45 |

FOREIGN PATENT DOCUMENTS 2103551 2/1983 United Kingdom .

*Primary Examiner*—Terry Lee Melius
*Assistant Examiner*—Fredrick Conley
*Attorney, Agent, or Firm*—Christie, Parker & Hale, LLP

[57] ABSTRACT

Folding furniture for recreational vehicles (RVs). The furniture includes a seating portion, a back portion, two sets of foldover arms, and a pair of hinging brackets. The seating and back portions have a front edge, left and right side edges, and a rear edge, and have an upper surface and a lower surface. Each set of foldover arms includes two non-straight arm portions, each with a seating portion connecting end and a back portion connecting end. The seating portion connecting ends are pivotally connected to the side edges of the seating portion, and the back portion connecting ends are pivotally connected to the side edges of the back portion, to form a pivotally attached together seating and back portion. Thus connected, the back portion can be pivoted backwardly in a generally uprightslanted back manner adjacent to the rear edge of the seating portion to define a seating mode, and permit the back portion to be pivoted frontwardly in a generally horizontal manner such that the rear edge of the framework of the back portion is adjacent to the front edge of the seating portion to define a bed mode. The hinging brackets are hingeably attached to the seating portion and are affixed to a vertical inside wall of the RV. The hinging brackets allow the seating and back portions to swing up to a vertical storage mode adjacent to the vertical wall of the RV and to swing down to the bed mode.

17 Claims, 5 Drawing Sheets

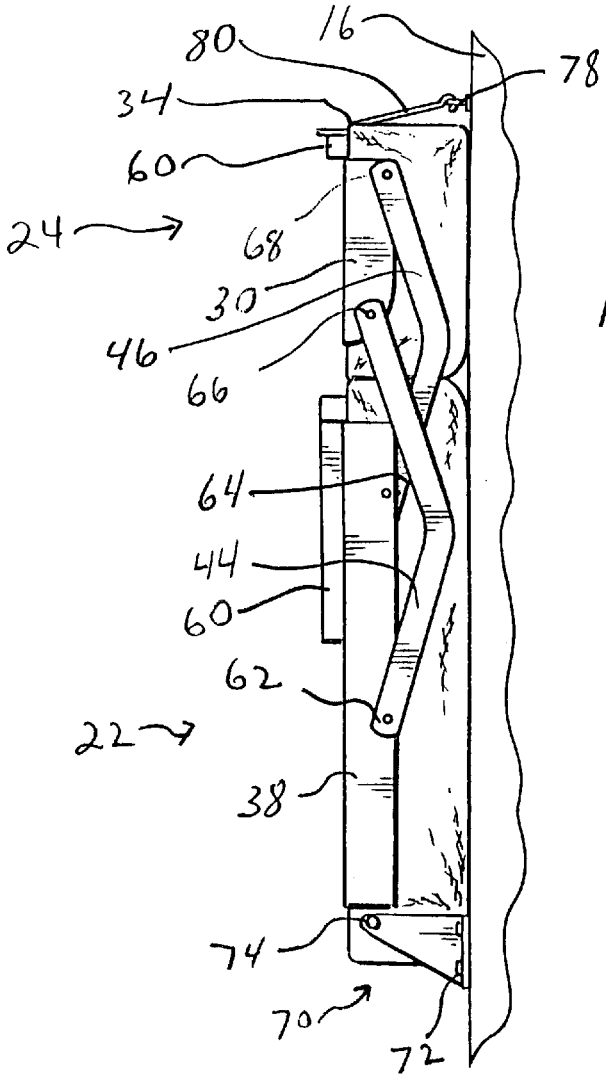
FIG. 3
FIG. 4
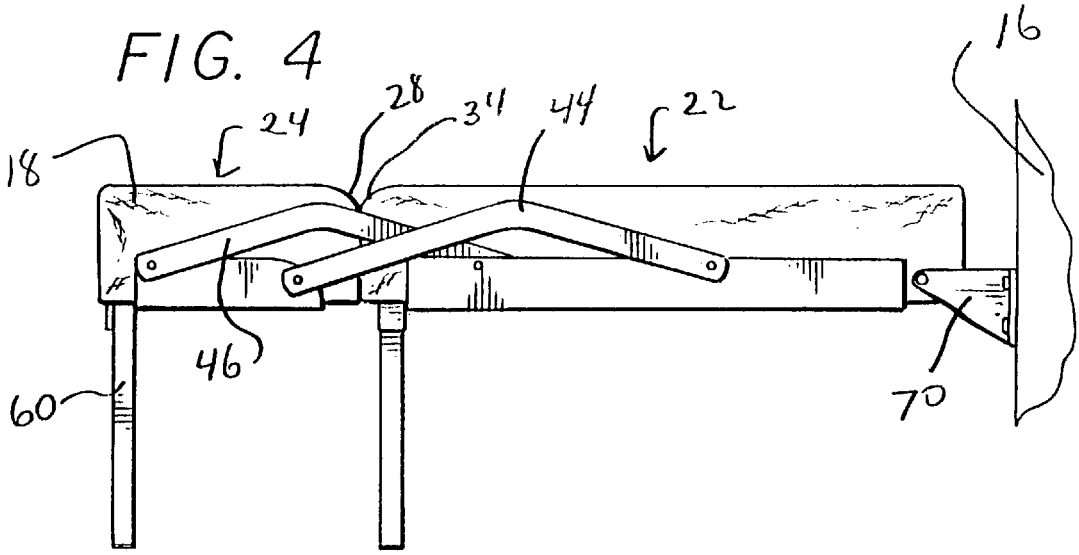

FOLDING RV FURNITURE

BACKGROUND OF THE INVENTION

1. Field of the Invention

The invention relates to the field of furniture for recreational vehicles including self-contained motorized vehicles as well as trailers hauled by pickup trucks and other vehicles, and more particularly to folding RV furniture, namely, a foldable sofa/bed and a foldable table seating/bed that will fold relatively flat against side walls of the recreational vehicle to maximize the floor space for storage of motorcycles, dune buggies, other motorized vehicles, and other gear during travel.

2. Description of Related Arts

In recent years, new styles of recreational vehicles and trailers (hereinafter "RVs") have been developed that include extra an wide rear door or doors that swing open or drop down to permit dune buggies, two, three and four-wheel motorcraft, and other items to be carried inside the RV during travel, which items can be easy stowed and unstowed. After the RV user arrives at the site, the wide door or doors of the RV are opened and the carried items are moved out of the RV. In order to maximize the space inside of the RV available for storing these various items, tables, seating, bedding, and the like are best moved out of the way and stowed away. In order to set up the tables, seating, beds, etc., after the carried items are moved out of the RV, the user will typically need to spend a considerable amount of time and effort to remove the tables, seating, beds, etc., from their stowed location in the RV and setting them up. When the user is ready to go, he or she will have to reverse the process. As a result, most users prefer not to move the parked site of the RV much.

There have been other attempts to provide folding RV furniture. U.S. Pat. No. 5,787,522 to Swihart discloses a sofa-bed assembly for RVs or vans and has a seat portion and a back portion connected together with a pair of swing arms. The other ends of the swing arms are connected to a permanently affixed floor mounted storage unit or base. Swing down support legs are provided. The swing arms allow the assembly to be positioned in a couch arrangement and in a bed arrangement. When folded, the assembly does not fold flat against the wall of the RV, and the seat back portion extends over the floor mounted storage unit.

U.S. Pat. No. 4,110,855 to Acker and U.S. Pat. No. 4,625,347 to McElmurry et al. also disclose rollover back sofa-bed arrangements. Both of these two references likewise disclose that the seat portions sit on bases sitting on the floor surface and the rollover arms are connected to the base portion.

U.S. Pat. No. 3,675,965 to Burdett discloses a folding bed assembly for a van. In the Burdett assembly, the bed folds relatively flat up against the sidewall of the van, but does not fold out into a couch. In the Burdett embodiment, legs support two sections of the bed, which automatically unfold along with the rest of the bed, as the bed is unfolded. A latch retains the folded bed up against the sidewall of the van.

U.S. Pat. No. 4,005,898 to Way discloses a convertible bench/bed structure and also an associated foldable table for pickup trucks. The Way convertible bench/bed structure is foldable with the seat portion and a back portion, and has foldout legs to support the bed. When folded out into its bed mode, the seat and back portions lie in a flat, horizontal orientation. When folded into its bench mode, the back portion is folded up. In its closed position, the seat and back portions are folded against each in a horizontal orientation. The Way convertible seat/bed structure includes vertically positioned U-shaped channels to which are slideably connected the seat and back portions. The Way patent also discloses a folding table that is attached to the front of the pickup truck's bed adjacent the cab of the truck.

While the above noted folding furniture are acceptable for mounting in van, pickup trucks, and the like, they are not particularly well-adapted to the newer style of RVs and trailers have been developed that include extra an wide rear door or doors. There accordingly remains a need for a sturdy, easy to fold and unfold furniture adapted for use in recreational vehicles including trailers.

SUMMARY OF THE INVENTION

One object of the invention is to provide folding sofa/bed RV furniture and foldable table seating/bed RV furniture that when folded in their storage position will remain relative flat against the wall of the RV without any portions remaining on the floor of the RV.

Another object of the invention is to provide folding sofa/bed RV furniture and foldable table seating/bed RV furniture that is easy and quick to fold and unfold, namely furniture that a single person can easily and quick fold down into a sofa mode or bed mode, in the case of the folding sofa/bed RV furniture, and into a table seating mode or bed mode, in the case of the table seating/bed RV furniture.

Yet another object of the invention is to provide a sturdy yet relatively light weight folding sofa/bed RV furniture and foldable table seating/bed RV furniture that incorporates an internal framework of metal for maximum strength.

These and other objects of the invention are satisfied by providing a

The device alternatively includes a

BRIEF DESCRIPTION OF THE DRAWINGS

FIG. 3 is a side view showing the first embodiment of the folding furniture in its storage mode.

FIG. 4 is a side perspective view showing the first embodiment of the folding furniture in its bed mode.

DISCUSSION OF THE PREFERRED EMBODIMENT

Figures 1, 2:
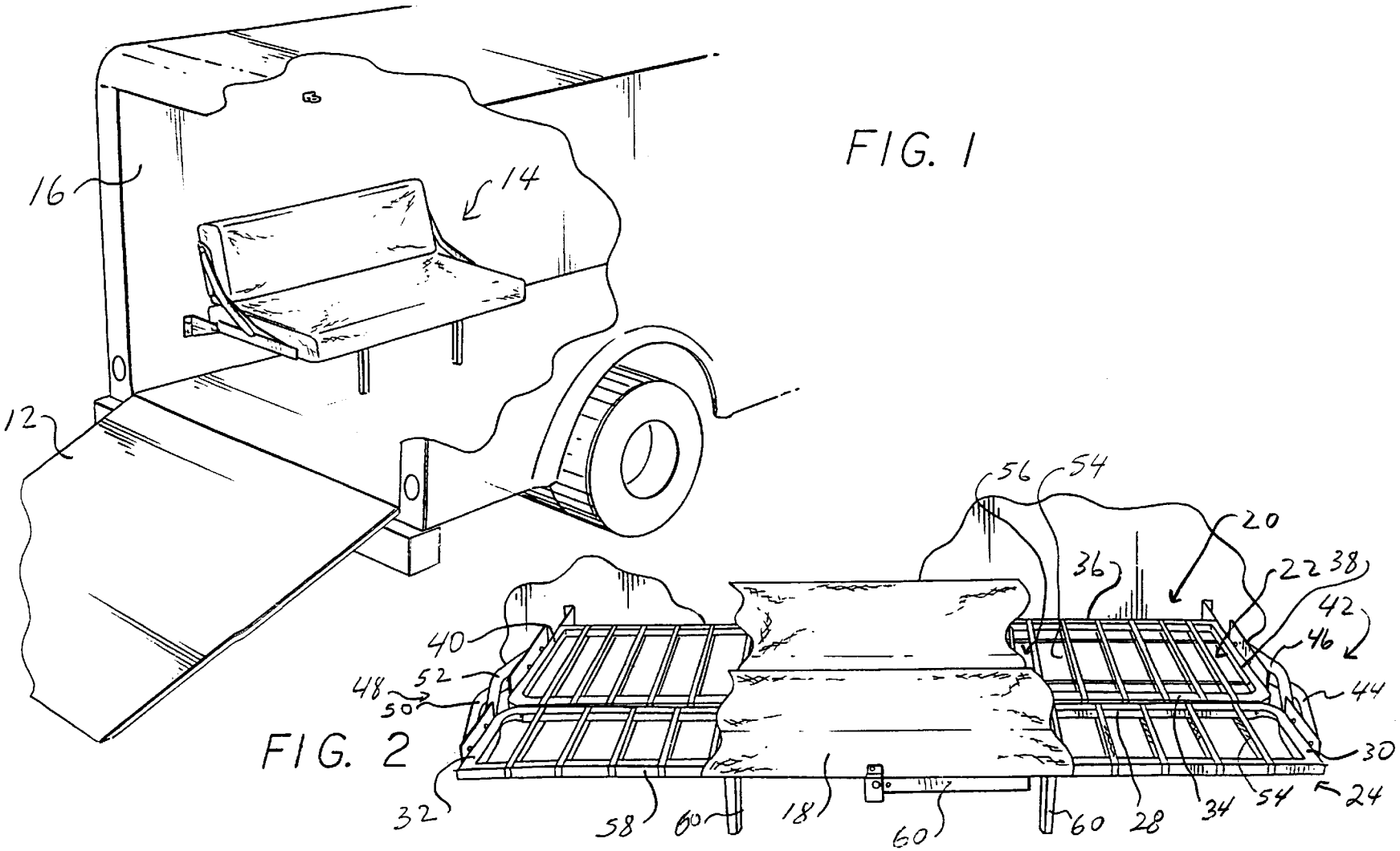
FIG. 1 is a diagrammatic right side perspective view showing a first embodiment of the folding furniture of the invention in its seating mode mounted to an inside wall of a recreational vehicle.
FIG. 2 is a partially exposed front perspective view showing the first embodiment of the folding furniture in its bed mode with portions of the padding and upholstery cut away to show the framework.

Turning first to FIG. 1, there is shown a diagrammatic right side perspective view showing a recreational vehicle 10 with a rear ramp 12 in its lowered position. A first embodiment of the folding furniture 14 is shown affixed to a inside wall 16 of the RV in its seat mode. As used herein the term "recreational vehicle" or "RV" shall refer both to trailers hauled by vehicles as well as to vehicles with self-contained amenities such as beds, coaches, cabinets, etc.

Referring now to FIG. 2, there is shown a partially exposed front perspective view showing the first embodiment of the folding furniture 14 in its bed mode with portions of the padding and upholstery 18 cut away to show the framework 20 of the folding furniture 14. As is shown, the folding furniture includes a seating portion 22 and a seating portion 24. Seating portion 22 has a front edge 26, a rear edge 28, and a right side edge 30 and a left side edge 32. Back portion 22 has a front edge 34, a rear edge 36, and a right side edge 38 and a left side edge 40. A right side set of foldover arms 42 comprises two arms 44 and 46. A left side set of foldover arms 48 likewise comprises two arms 50 and 52. Arms 44 and 46 are used to pivotally connect together the right side edge 30 of back portion 22 to the right side edge 38 of seating portion 24. Arms 50 and 52 are used to pivotally connect together the left side edge 40 of back portion 22 to the left side edge 32 of seating portion 24. Strap means 54, including but not limited to nylon straps can be used to bridge the framework 20 of the seating portion 22 and the seating portion 24. As shown, the upholstery 18 covers an upper surface 56 of the seating portion 22 and the seating portion 24. The seating portion 22 and the seating portion 24 also have a lower surface 58. Fold down legs 60 are affixed to and extend below the bottom of the lower surface 58 of the seating portion 22 and/or the seating portion 24. Preferably, fold down legs 60 are affixed to both the seating portion 22 and the seating portion 24. FIG. 2 shows fold down leg 60 attached to seating portion 24 in its folded up position.

Next, turning to FIG. 3, there is shown a right side view of the first embodiment of the folding furniture 14 in its storage mode folded against the inner wall 16 of the RV. The right side set of foldover arms 42 with its two arms 44 and 46. Arms 44 and 46 each have seating portion connecting ends 62 and 64, respectively, which are pivotally connected to the right side edge 38 of seating portion 24, as well as back portion connecting ends 66 and 68, respectively, which are pivotally connected to the right side edge 30 of back portion 22. As can be seen, the foldover arms 44 and 46, and 50 and 52 comprise two bent portions. Hinging brackets 70 comprises wall attachment ends 72 for secure attachment to the vertical inside RV wall 16 as well as pivot ends 74 for hingeable attachment to the framework 24. As shown, hinging bracket 70 permit the pivotally attached together seating portion 22 and seating portion 24 to be swung up generally flat against inside wall 16 of the RV. A storage retention means 76 to retain the pivotally attached together back portion 22 and seating portion 24 in the vertically oriented storage position shown. The storage retention means 76 can comprise an eyehook 78 affixed to the inside wall 16 of the RV and a clasp 80 affixed to the front edge 36 of the back portion 24. Other known arrangements can be provided to retain the folding furniture in its storage mode.

FIG. 4 is a side perspective view showing the first embodiment of the folding furniture 14 in its bed mode. As shown, the folding legs 60 are swung down to their deployed position. In the bed mode, (as well as in the storage mode shown in FIG. 3) the rear edge 28 of the back portion 24 is adjacent to the front edge 34 of the seating portion 22, and the resulting bedding surface is horizontal with the upholstery 18 forming a generally continuous flat surface.

Figure 5:
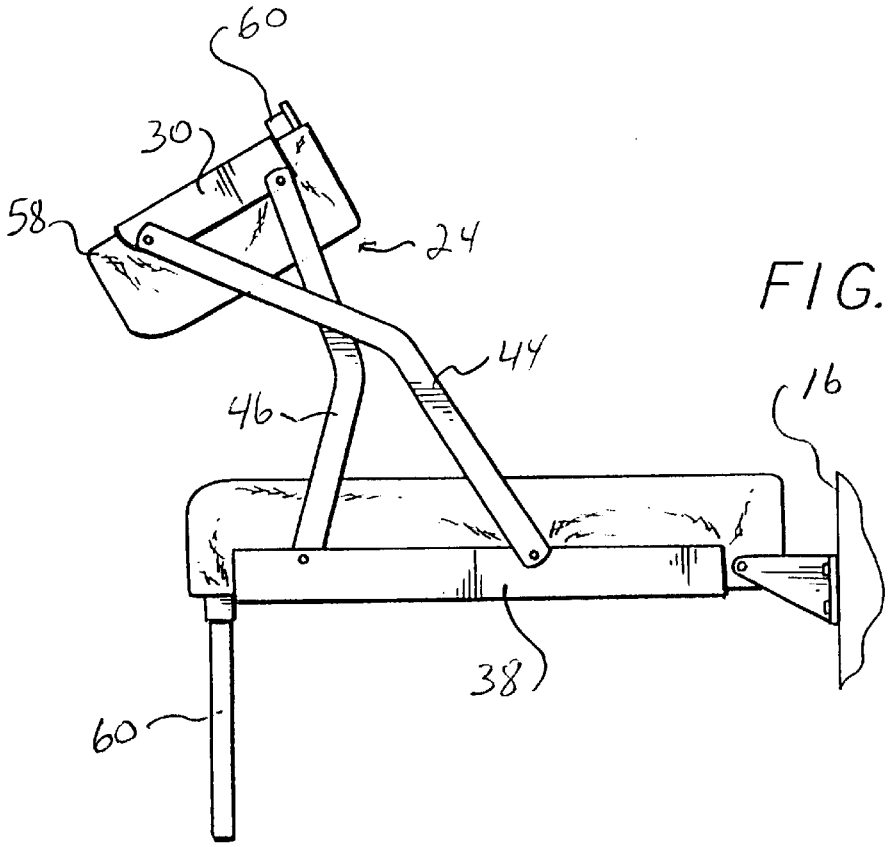
FIG. 5 is a side perspective view showing the first embodiment of the folding furniture being converted from its bed mode of FIG. 4 to its seating mode.
Figure 6:
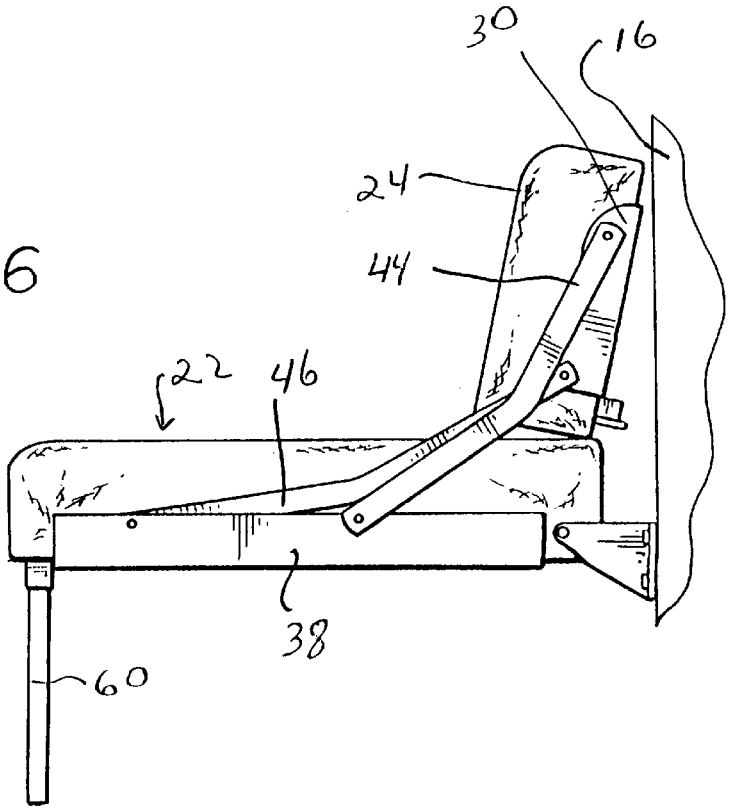
FIG. 6 is a side perspective view showing the first embodiment of the folding furniture in its seating mode.

Turning now to FIGS. 5 and 6, there is shown a side perspective view showing the first embodiment of the folding furniture 14 being converted from its bed mode of FIG. 4 to its seating mode, as shown in FIGS. 1 and 6. As can be seen, the leg 60 affixed to the seat portion 24 is folded up against lower surface 58 of back portion 24. The arms 44 and 46 permit back portion 24 to swing from its position shown in FIG. 4 up and back until back portion 24 lies in a generally upright or somewhat backwardly angled position adjacent the rear edge 36 of seating portion 22. In the process of pivoting back the back portion 24, the shape and position of mounting of the two arms 44 and 46 ensure that the back portion 24 lies in the proper position with respect to the seat portion 22.

Figure 7:
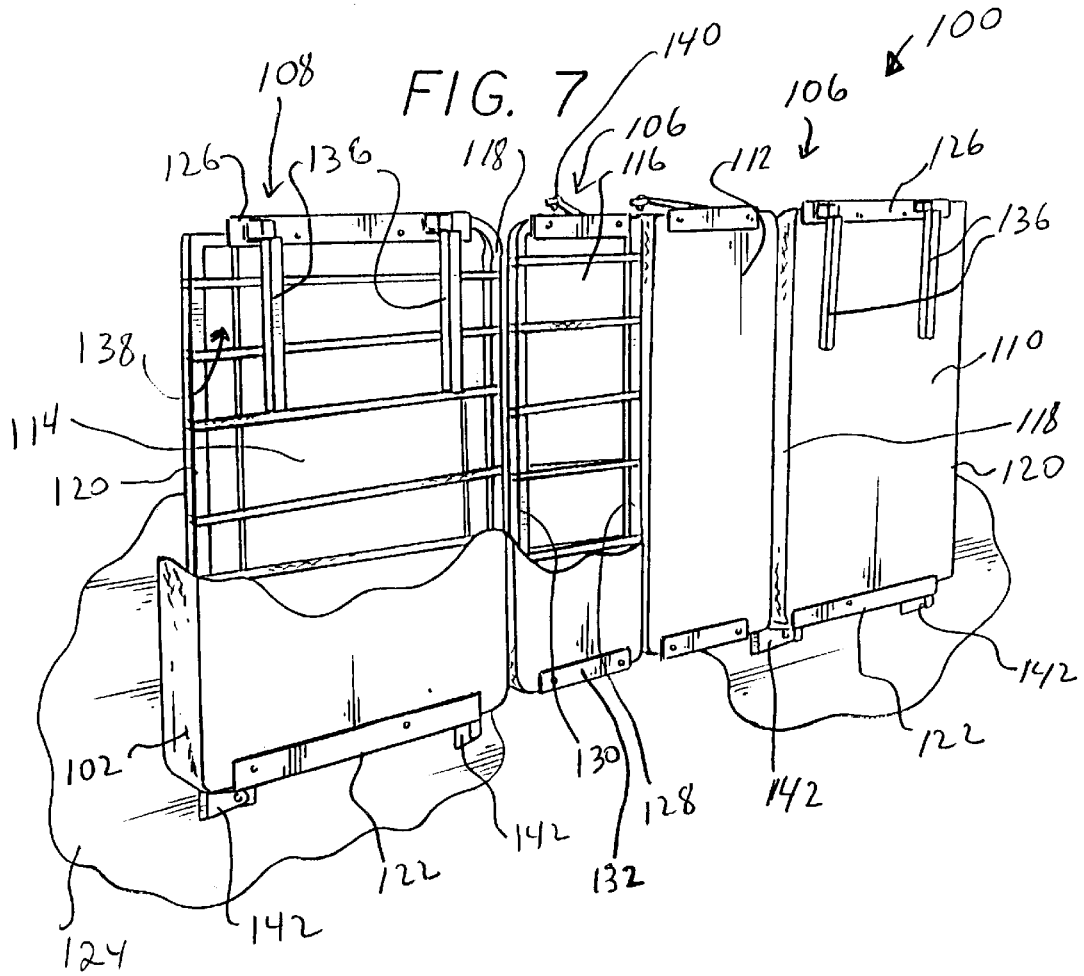
FIG. 7 is a left front perspective view of a second embodiment of the folding furniture in its storage mode, with portions of the upholstery removed to show details of the framework.

Referring now to FIG. 7, a left front perspective view of a second embodiment of the folding furniture 100 is shown in its storage mode, with portions of the upholstery 102 removed to show details of its framework 104. The second embodiment of the folding furniture 100 is similar to the first embodiment of folding furniture 14, and includes a right unit 106 and a left unit 108. The right unit 106 includes a seating portion 110 and a back portion 112, and the left unit 108 likewise includes a seating portion 114 and aback portion 116. Each of the right and left seating portions 110 and 114, respectively, has a front edge 118 and a back edge 120, a first side edge 122 closest to a vertical wall 124 of the RV and a second side edge 126 opposite the first side edge 122. Each of the right and left back portions 112 and 116, respectively, has a front edge 128 and a back edge 130, a first side edge 132 closest to the vertical wall 124 of the RV and a second side edge 134 opposite the first side edge 132. Folding legs 136 are affixed to an underside 138 of the framework 104 of the right unit 106 and left unit 108. Storage retention means 140 are provided to moveably retain folding furniture 100 in its storage mode. As shown, the first side edges 122 of the right and left back portions 110 and 116, respectively, are attaching with hinging brackets 142 to the vertical wall 124 of the RV. In the storage mode, the front edges 128 of the back portions 112 and 116 of the right and left units 106 and 108, respectively, lie close together, and the entire units lies generally flat against the vertical wall 124 of the RV.

Figure 8:
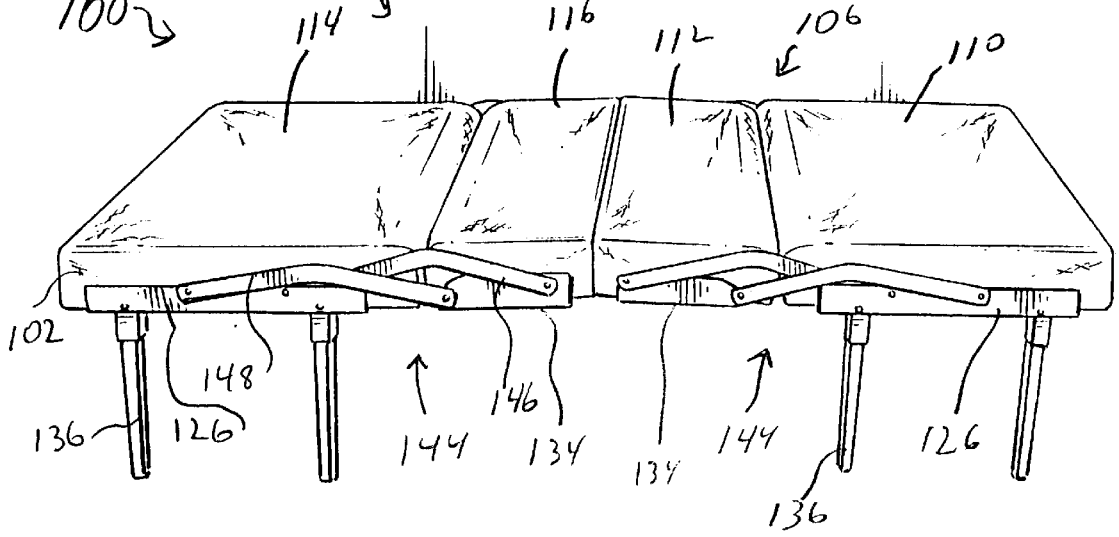
FIG. 8 is a front perspective view of the second embodiment of the folding furniture of FIG. 7 in its bed mode.

FIG. 8 shows the folding furniture 100 (completely upholstered) in its bed mode, with the folding legs 136 folded down. As can be seen, the seating portion 110 and the back portion 112 of the right unit 106 and the seating portion 114 and the back portion 116 of the left unit 108 are pivotally attached together with set of foldover arms 144, each having two arm portions 146 and 148. These arm portions 146 and 148 are non-straight. Two other sets of folding arms 144 pivotally attach together the first side edges 122 and 132 of the seating and back portions 110 and 112, and 114 and 16 of the right and left units 106 and 108, respectively. The front edges 128 of the back portions 112 and 116 of the right and left units 106 and 108, respectively, lie close together in the bed mode, such that the upholstery 102 forms a generally continuous bed surface.

Figure 9:
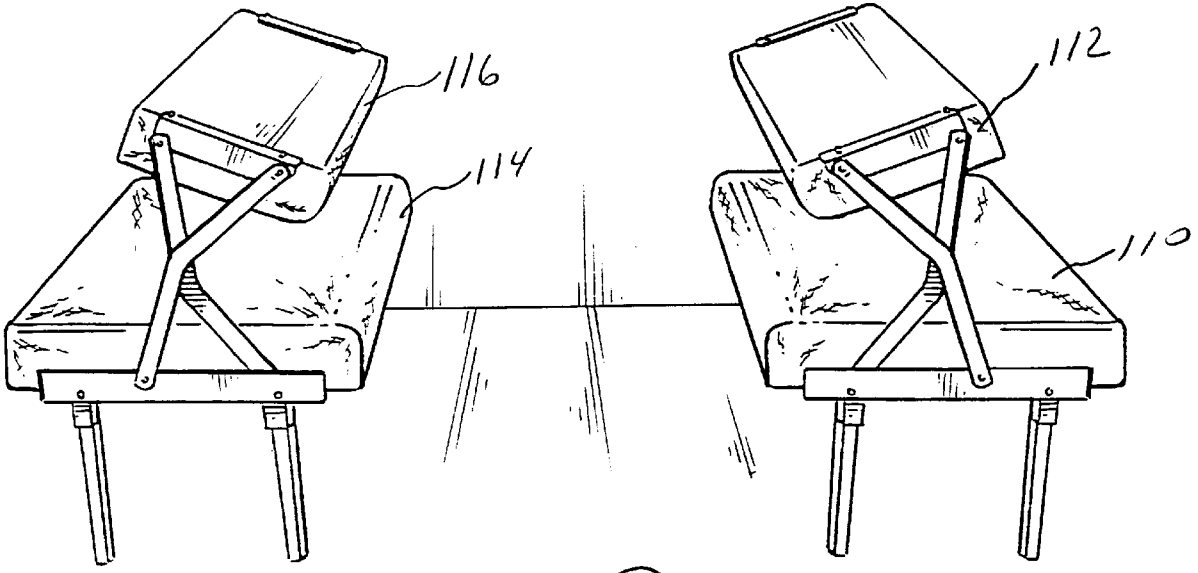
FIG. 9 is front perspective view showing the second embodiment of the folding furniture being converted from its bed mode of FIG. 8 to its seating mode with two opposed seats.
Figure 10:
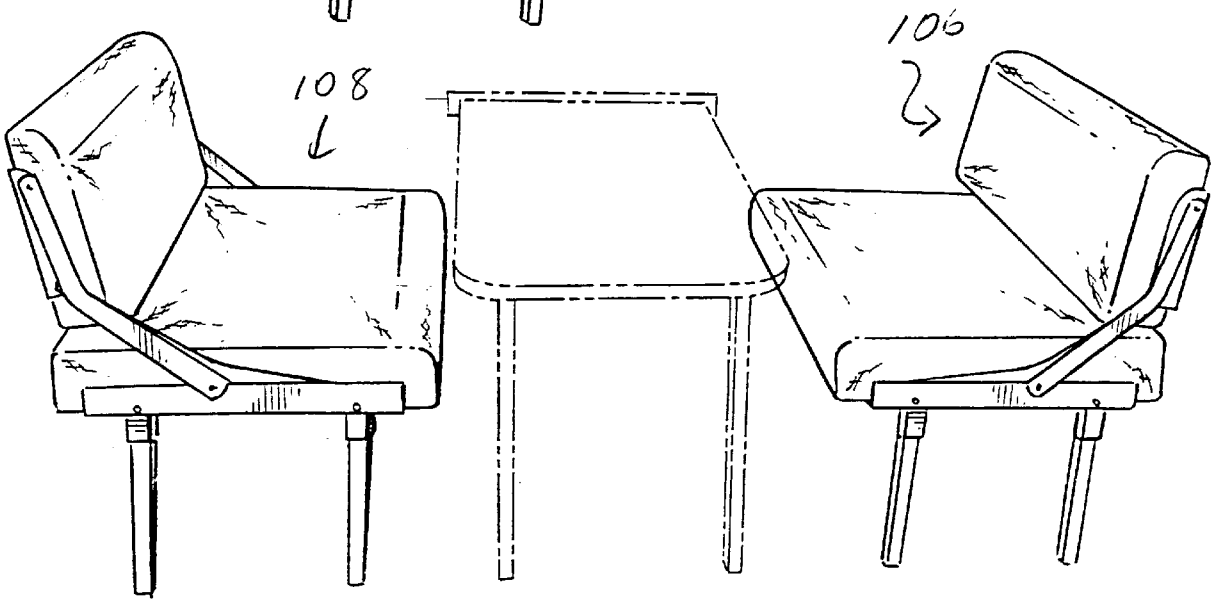
FIG. 10 is front perspective view showing the second embodiment of the folding furniture of FIG. 9 in its seating mode with two opposed seats with an optional fold down table shown (shown in phantom) folded down between the two seats.

Referring now to FIGS. 9 and 10, there are shown a front perspective view showing the second embodiment of the folding furniture 100 being converted from its bed mode of FIG. 8 to its seating mode of FIG. 10, with two opposed seats. The foldover arms 144 allow the back portion 112 and 116 to be swung up and back from their horizontal position of FIG. 8 to a upright and somewhat angled back position of FIG. 10, to thereby form the two oppositely facing right and left seating unit 106 and 108, respectively. A fold down table 150 (shown in phantom) can be provided between the right and left seating unit 106 and 108 to allow seating around the table 150.

Although a metal framework is preferably utilized in the embodiments of the folding furniture 14 and 110, the seat and back portions could be formed of plywood, solid plastic panels or blow molded structures (e.g. that might even have flexibility in the upper surface directly incorporated into the design) fiberglass, or more exotic materials (not shown.)

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation.

I claim:

1. Folding furniture for use with recreational vehicles having vertical walls and a floor surface, the folding furniture comprising:

a seating portion having a framework with a front edge, left and right side edges, and a rear edge, the seating portion having an upper surface and a lower surface;

a back portion having a framework with a front edge, left and right side edges, and a rear edge, the back portion having an upper surface and a lower surface;

a right side set and a left side set of foldover arms, each of the right side and left side sets of foldover arms comprising two non-straight arm portions, each with a seating portion connecting end and a back portion connecting end, the seating portion connecting ends of the right and left side sets of foldover arms being pivotally connected to the right and left side edges of the framework of the seating portion, respectively, and the back portion connecting ends of the right and left side sets of foldover arms being pivotally connected to the right and left side edges of the framework of the back portion, respectively, to form a pivotally attached together seating and back portion, wherein the right side set and the left side set of foldover arms are adapted to permit the back portion to be pivoted backwardly in a generally upright or slanted back manner adjacent to the rear edge of the seating portion, which seating portion remains in a horizontal orientation, to conform to a seating mode of the folding furniture, and permit the back portion to be pivoted frontwardly in a generally horizontal manner such that the rear edge of the framework of the back portion is adjacent to the front edge of the seating portion to conform to a horizontal bed mode of the folding furniture; and hinging brackets that are hingeably attached to the framework of the seating portion, wherein the hinging brackets permit the pivotally attached together seating and back portions to swing up to a vertical storage position and to swing down to the horizontal bed mode of the folding furniture, and wherein when the seating and back portions are swung up to the vertical storage position, no portion of the folding furniture remains on a floor surface.

2. The folding furniture for recreational vehicles of claim 1, further comprising fold down legs attached to at least one of the seating portion and the back portion.

3. The folding furniture for recreational vehicles of claim 2, wherein the fold down legs are hingeably attached to at least one of the seating portion and the back portion, and include means to selectively keep the fold down legs in a first, closed position adjacent to the lower surface of framework of the seating portion and/or the back portion, and a deployed position that extends perpendicular from the lower surface of the seating portion and/or the back portion.

4. The folding furniture for recreational vehicles of claim 1, further including means to retain the pivotally attached together seating and back portions in the swing up vertical storage position adjacent to the vertical wall of the recreational vehicle.

5. The folding furniture for recreational vehicles of claim 1, wherein the seating portion, back portion, right side set and a left side set of foldover arms, and hinging brackets are made of metal.

6. The folding furniture for recreational vehicles of claim 1, wherein the upper surfaces of the seating portion and back portion are upholstered.

7. The folding furniture for recreational vehicles of claim 1, wherein a plurality of straps are secured around the framework of the seating portion and the framework of the back portion, and the upper surfaces of the seating portion and back portion are upholstered.

8. The folding furniture for recreational vehicles of claim 1, wherein the folding furniture comprises a single pivotally attached together seating and back portion wherein the pair of hinging brackets are hingeably attached to the rear edge of the framework of the seating portion.

9. The folding furniture for recreational vehicles of claim 1, wherein the folding furniture comprises a single pivotally attached together seating and back portions, wherein the pair of hinging brackets are hingeably attached to one of the left and right side edges of the framework of the seating portion.

10. The folding furniture for recreational vehicles of claim 1, wherein the folding furniture comprises two seating portions and two back portions that are joined together by two right side sets and two left side sets of foldover arms into two separate pivotally attached together seating and back portions, wherein the hinging brackets are hingeably attached to one of the right and left side edges of the framework of the seating portion, wherein the two separate pivotally attached together seating and back portions are placed in a spaced apart orientation such that each of the two separate pivotally attached together seating and back portions form oppositely facing seats when in the seating mode, and to together form a continuous, horizontal bed when in the bed mode.

11. The folding furniture for recreational vehicles of claim 1, wherein the framework of the seating portion and back portion are rectangular in shape.

12. Folding furniture for use with recreational vehicles having vertical walls and a floor surface, the folding furniture comprising:

a seating portion defining a generally planar structure having a front edge, left and right side edges, and a rear edge, the seating portion having an upper surface and a lower surface;

a back portion defining a generally planar structure with a front edge, left and right side edges, and a rear edge, the back portion having an upper surface and a lower surface;

a right side set and a left side set of foldover arms, each of the right side and left side sets of foldover arms comprising two non-straight arm portions, each with a seating portion connecting end and a back portion connecting end, the seating portion connecting ends of the right and left side sets of foldover arms being pivotally connected to the right and left side edges of the seating portion, respectively, and the back portion connecting ends of the right and left side sets of foldover arms being pivotally connected to the right and left side edges of the back portion, respectively, to form a pivotally attached together seating and back portion, wherein the right side set and a left side set of foldover arms are adapted to permit the back portion to be pivoted backwardly in a generally upright or slanted back manner adjacent to the rear edge of the seating portion, which seating portion remains in a horizontal orientation, to conform to a seating mode of the folding furniture, and permit the back portion to be pivoted frontwardly in a generally horizontal manner such that the rear edge of the back portion is adjacent to the front edge of the seating portion to conform to a horizontal bed mode of the folding furniture; and hinging brackets that are hingeably attached to the seating portion, wherein the hinging brackets permit the pivotally attached together seating and back portions to swing up to a vertical storage position and to swing down to the horizontal bed mode of the folding furniture, and wherein when the seating and back portions are swung up to the vertical storage position, no portion of the folding furniture remains on a floor surface.

13. The folding furniture for recreational vehicles of claim 12, further comprising fold down legs attached to at least one of the seating portion and the back portion.

14. The folding furniture for recreational vehicles of claim 12, wherein the upper surfaces of the seating portion and back portion are upholstered.

15. The folding furniture for recreational vehicles of claim 12, wherein the folding furniture comprises a single pivotally attached together seating and back portion wherein the pair of hinging brackets are hingeably attached to the rear edge of the seating portion.

16. The folding furniture for recreational vehicles of claim 12, wherein the folding furniture comprises a single pivotally attached together seating and back portions, wherein the pair of hinging brackets are hingeably attached to one of the right and left side edges of the seating portion.

17. The folding furniture for recreational vehicles of claim 12, wherein the folding furniture comprises two seating portions and two back portions that are joined together by two right side sets and two left side sets of foldover arms into two separate pivotally attached together seating and back portions, wherein the hinging brackets are hingeably attached to one of the right and left side edges of the framework of the seating portion, wherein the two separate pivotally attached together seating and back portions are placed in a spaced apart orientation such that each of the two separate pivotally attached together seating and back portions form oppositely facing seats when in the seating mode, and to together form a continuous, horizontal bed when in the bed mode.

* * * * *